US011040799B1

(12) United States Patent
Sommer et al.

(10) Patent No.: US 11,040,799 B1
(45) Date of Patent: Jun. 22, 2021

(54) PALLET WITH IMPACT RESISTANCE

(71) Applicant: Monoflo International, Inc., Winchester, VA (US)

(72) Inventors: Axel Sommer, Tacoma, WA (US); Tillman Schmid, Winchester, VA (US)

(73) Assignee: Monoflo International, Inc., Winchester, VA (US)

( * ) Notice: Subject to any disclaimer, the term of this patent is extended or adjusted under 35 U.S.C. 154(b) by 0 days.

(21) Appl. No.: 16/750,018

(22) Filed: Jan. 23, 2020

(51) Int. Cl.
*B65D 19/00* (2006.01)

(52) U.S. Cl.
CPC .... *B65D 19/004* (2013.01); *B65D 2519/0094* (2013.01); *B65D 2519/00273* (2013.01); *B65D 2519/00288* (2013.01); *B65D 2519/00318* (2013.01); *B65D 2519/00338* (2013.01)

(58) Field of Classification Search
CPC ..... B65D 19/004; B65D 2519/00318; B65D 2519/00288; B65D 2519/00273; B65D 2519/0094; B65D 2519/00338
See application file for complete search history.

(56) References Cited

U.S. PATENT DOCUMENTS 3,698,677 A * 10/1972 Looker ..... B60P 7/0815 248/346.02
6,237,509 B1 * 5/2001 Ishido ..... B65D 19/0012 108/57.25
8,448,583 B2 * 5/2013 Apps ..... B65D 19/38 108/57.25
9,714,116 B2 * 7/2017 Rader ..... B65D 19/0016
2001/0029874 A1 * 10/2001 Muirhead ..... B65D 19/38 108/57.25
2002/0017225 A1 * 2/2002 Koefelda ..... B65D 19/0018 108/53.3
2002/0088380 A1 * 7/2002 Hale ..... B65D 19/0012 108/57.26
2004/0134390 A1 * 7/2004 Apps ..... B65D 19/0018 108/53.1
2005/0237184 A1 * 10/2005 Muirhead ..... B29C 48/07 340/539.13
2006/0254476 A1 * 11/2006 MacDonald ..... B65D 19/0038 108/53.3
2007/0131148 A1 * 6/2007 Wu ..... B65D 19/0018 108/57.25
2007/0256609 A1 * 11/2007 Naidu ..... B65D 19/0095 108/108
2008/0011205 A1 * 1/2008 Haaf ..... B65D 19/0036 108/53.3
2008/0210138 A1 * 9/2008 Ishibashi ..... B65D 19/0012 108/51.3
2008/0295748 A1 * 12/2008 Yoshida ..... B65D 19/0026 108/55.1
2011/0005436 A1 * 1/2011 Lee ..... B65D 19/0051 108/57.32

(Continued)

*Primary Examiner* — Hanh V Tran
(74) *Attorney, Agent, or Firm* — Nixon & Vanderhye P.C.

(57) ABSTRACT

A pallet includes a lower panel, a plurality of feet, and a perimeter fault in the lower panel extending adjacent a perimeter of the lower panel. The pallet may also include a plurality of surrounding faults in the lower panel, where each of the surrounding faults extends around a respective one of the plurality of feet. The faults or recesses allow for an engineered region of reduced stiffness in line with the loads seen during impacts in the leading edge or feet of the pallet.

20 Claims, 5 Drawing Sheets

(56) References Cited

U.S. PATENT DOCUMENTS

| | | | | |
|---|---|---|---|---|
| 2011/0232539 | A1* | 9/2011 | Broerman | B65D 19/0036 108/53.1 |
| 2012/0048154 | A1* | 3/2012 | Toomer | B65D 19/0018 108/53.3 |
| 2015/0083715 | A1* | 3/2015 | Shuert | B65D 19/0097 220/1.5 |
| 2015/0274360 | A1* | 10/2015 | Dye | B65D 5/526 206/597 |
| 2017/0081075 | A1* | 3/2017 | Bruce | B29C 65/02 |
| 2017/0121097 | A1* | 5/2017 | Pranadi | B65D 81/3823 |
| 2017/0174391 | A1* | 6/2017 | Burk | B65D 19/004 |
| 2017/0197752 | A1* | 7/2017 | Imbrecht | B65D 19/44 |
| 2017/0225827 | A1* | 8/2017 | Ikeguchi | B65D 19/44 |
| 2018/0072457 | A1* | 3/2018 | Liang | C08J 11/00 |
| 2018/0099779 | A1* | 4/2018 | Apps | B65D 19/0008 |
| 2018/0141705 | A1* | 5/2018 | Erm | B65D 19/0075 |
| 2018/0215505 | A1* | 8/2018 | Hawley | B65D 19/0095 |
| 2018/0370681 | A1* | 12/2018 | Lin | B65D 19/0026 |
| 2019/0031222 | A1* | 1/2019 | Takyar | B62B 3/16 |
| 2019/0092523 | A1* | 3/2019 | Wu | B27N 5/00 |
| 2019/0367213 | A1* | 12/2019 | Benedetti | B27N 3/22 |
| 2020/0039685 | A1* | 2/2020 | Weeks | B65D 19/40 |

* cited by examiner

PALLET WITH IMPACT RESISTANCE

CROSS-REFERENCES TO RELATED APPLICATIONS (Not Applicable)

STATEMENT REGARDING FEDERALLY SPONSORED RESEARCH OR DEVELOPMENT (Not Applicable)

BACKGROUND

The invention relates to a pallet construction and, more particularly, to a pallet construction with a built-in energy absorption feature to accommodate loads by impact in the leading edge or feet of the pallet.

It is desirable to increase the impact resistance of a welded pallet foot and leading edge. In use, plastic molded pallets support stacks of product and are typically moved using a forklift. It is not uncommon for a forklift operator to impact the side or feet of the pallets with the tines of the forklift. Improving the impact resistance of a welded pallet will expand the useful life of the pallet.

SUMMARY

The described embodiments include a built-in energy absorption feature in the form of a sharp and narrow recess or fault in the lower deck of a pallet and surrounding the feet of the pallet. This recess or fault allows for an engineered region of lower stiffness in line with the loads seen during impacts in the leading edge or feet of the pallet. A portion of the fault may have a thinner wall thickness that acts as a flexure in the case of a foot or leading-edge impact. This flexure region will bend rather than buckle or otherwise deform axially. Load transfer into members that are parallel to the impact vector will create axial compressive loads that result in very little deformation for relatively high stress. High stress causes failure, and more deformation means more energy absorbed. The described embodiments utilize bending mechanics to allow for high deformation with relatively low stress. In the case of an impact in the leading edge or foot, the normal compression loading seen in the pallet structure is instead converted into bending loading.

Similarly, in the case of a foot impact, the typical critical loading is the tension stress created. This is once again transformed with the described embodiments into a bending scenario. In a typical plastic pallet, the foot bends back upon impact creating a region of high tensile stress in the radius that connects the foot to the rest of the pallet. This radius is a weak point that concentrates the stress that often causes failure at the radius. Typically, the rest of the pallet is too stiff to absorb the impact, so the stress cannot be distributed to surrounding areas. The fault around the feet defines a bending region that will bend and distribute the load among more material rather than concentrate the tensile stress to the radius. It is beneficial to extend the fault around the entire foot so that the compression stress seen on the back side of the foot is also converted into bending.

In an exemplary embodiment, a pallet includes an upper panel with a plurality of openings, a lower panel secured to the upper panel, and a plurality of feet aligned with the plurality of openings in the upper panel. A plurality of ribs are disposed between the lower panel and the upper panel, and a perimeter fault in the lower panel extends adjacent a perimeter of the lower panel.

The perimeter fault may be continuous adjacent an entirety of the lower panel perimeter.

The perimeter fault may extend from foot to foot among the plurality of feet. The perimeter fault between respective ones of the plurality of feet may include two straight sections that join at a vertex.

The pallet may also include a plurality of surrounding faults in the lower panel, where each of the surrounding faults extends around a respective one of the plurality of feet, and the plurality of feet extend from a surface defined by the surrounding faults. In this context, the perimeter fault may be partially contiguous with the surrounding faults. The surrounding faults and the perimeter fault may be three-sided in cross-section. The three-sided cross-section of the perimeter fault may include an outermost wall, a connecting wall, and an innermost wall, and the outermost wall may be more flexible than the connecting wall and the innermost wall. The three-sided cross-section of the surrounding faults may include an outer circumferential wall, a joining wall, and an inner circumferential wall, and the joining wall may be more flexible than the inner and outer circumferential walls.

In another exemplary embodiment, a pallet includes a lower panel, a plurality of feet, and a plurality of surrounding faults in the lower panel, where each of the surrounding faults extend around a respective one of the plurality of feet, and where the plurality of feet extend from a surface defined by the surrounding faults.

In still another exemplary embodiment, a pallet includes an upper panel including a plurality of openings, a lower panel secured to the upper panel, and a plurality of feet aligned with the plurality of openings in the upper panel. A plurality of ribs are disposed between the lower panel and the upper panel. A perimeter fault in the lower panel extends adjacent a perimeter of the lower panel, and a plurality of surrounding faults in the lower panel each extend around a respective one of the plurality of feet, with the plurality of feet extending from a surface defined by the surrounding faults. The perimeter fault extends between the surrounding faults among the plurality of feet.

BRIEF DESCRIPTION OF THE DRAWINGS

These and other aspects and advantages will be described in detail with reference to the accompanying drawings, in which.

DETAILED DESCRIPTION

Figure 1:
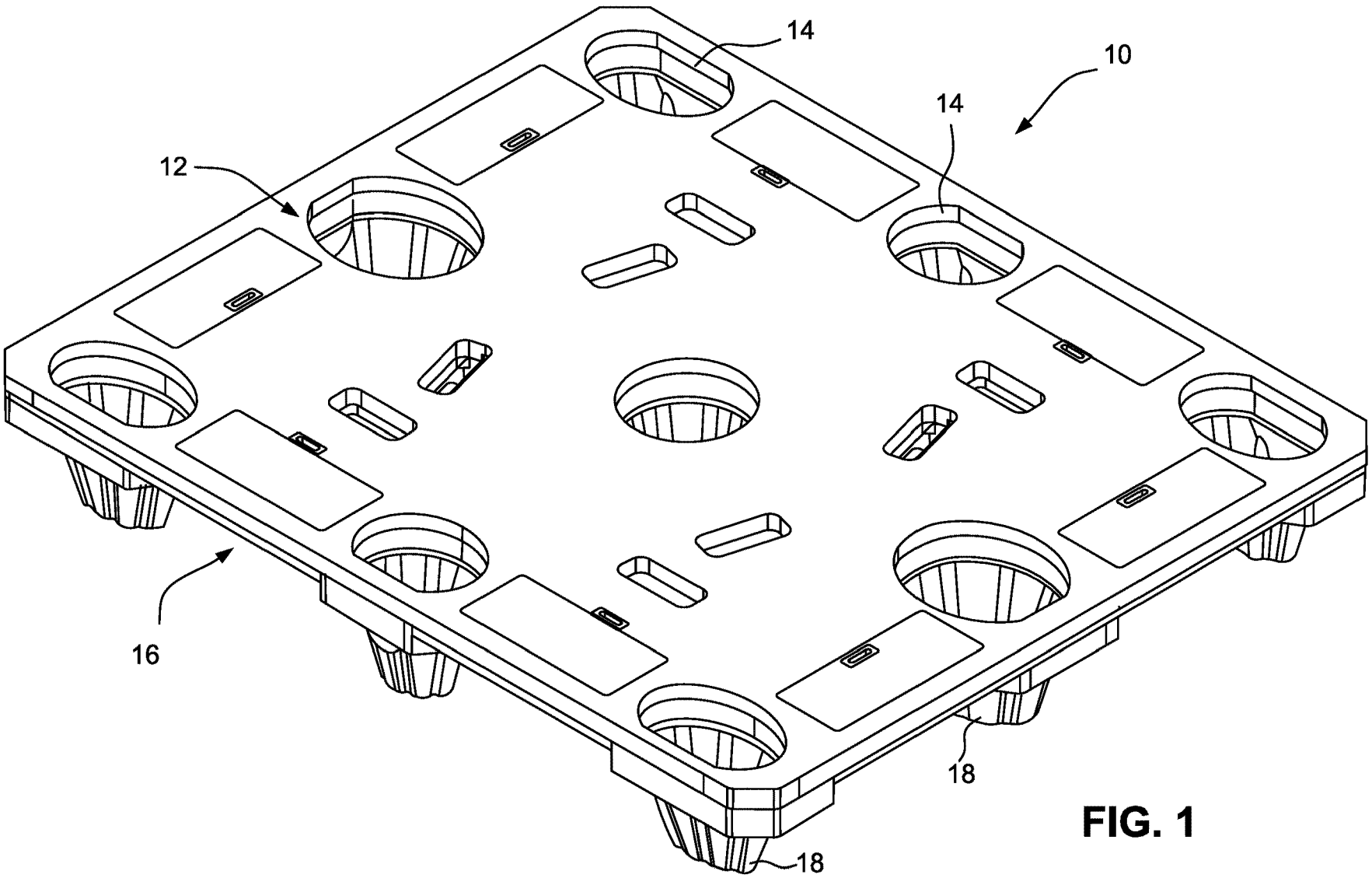
FIGS. 1 and 2 are perspective views of an assembled pallet.
Figure 2:
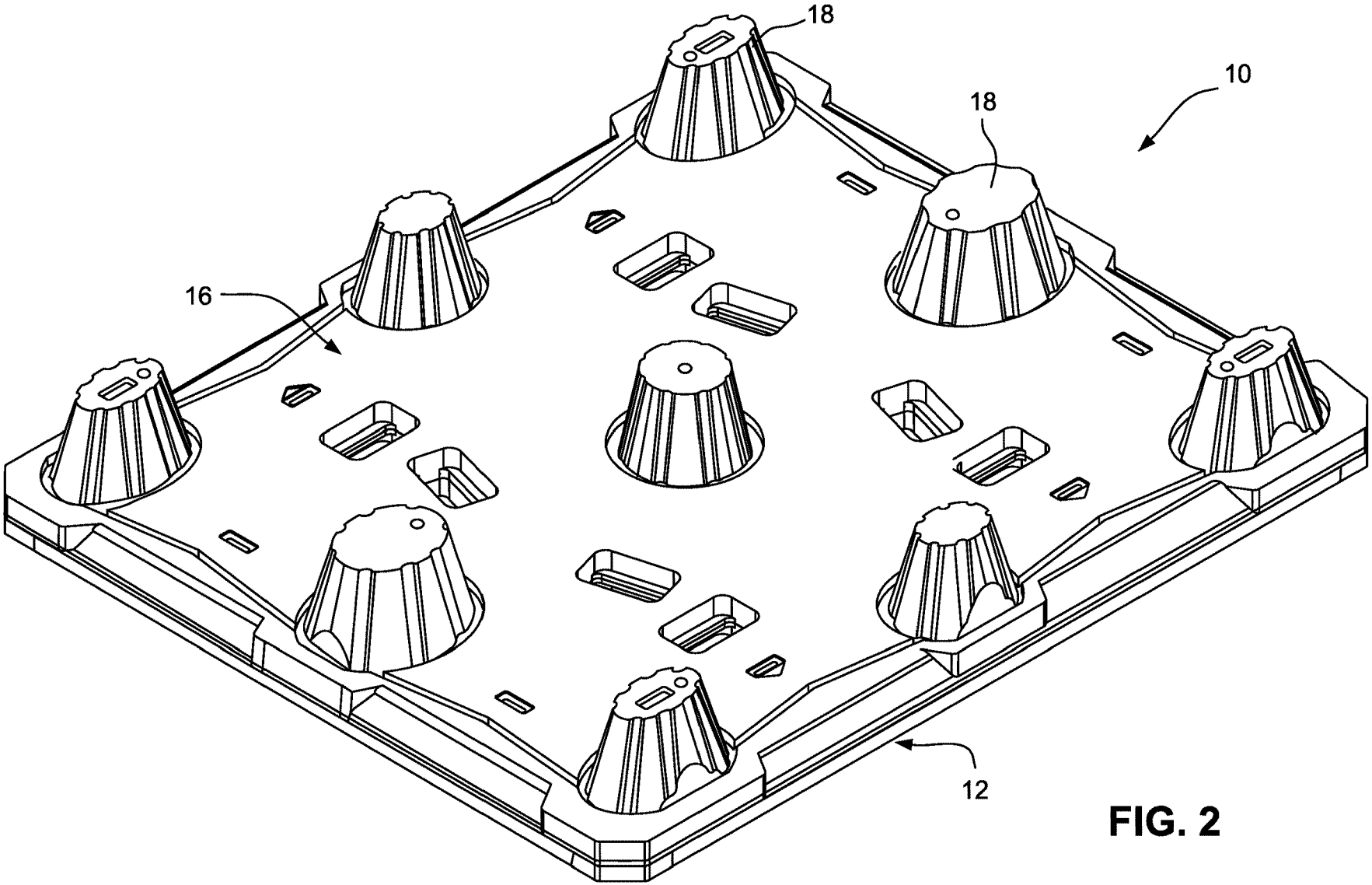

FIGS. 1 and 2 are perspective views of an assembled pallet 10. The pallet 10 generally includes an upper panel 12 with a plurality of openings 14. The pallet 10 is also shown with various handles and grommets. A lower panel 16 is secured to the upper panel 12. With reference to FIG. 1, a plurality of feet 18 are aligned with the plurality of openings 14 in the upper panel 12. In some embodiments, the feet 18 are tapered and are hollow to facilitate stacking/nesting with an adjacent pallet. That is, in order to stack/nest empty pallets, the feet of an adjacent pallet can fit through the openings 14 of a pallet below into a nested configuration.

Figure 3:
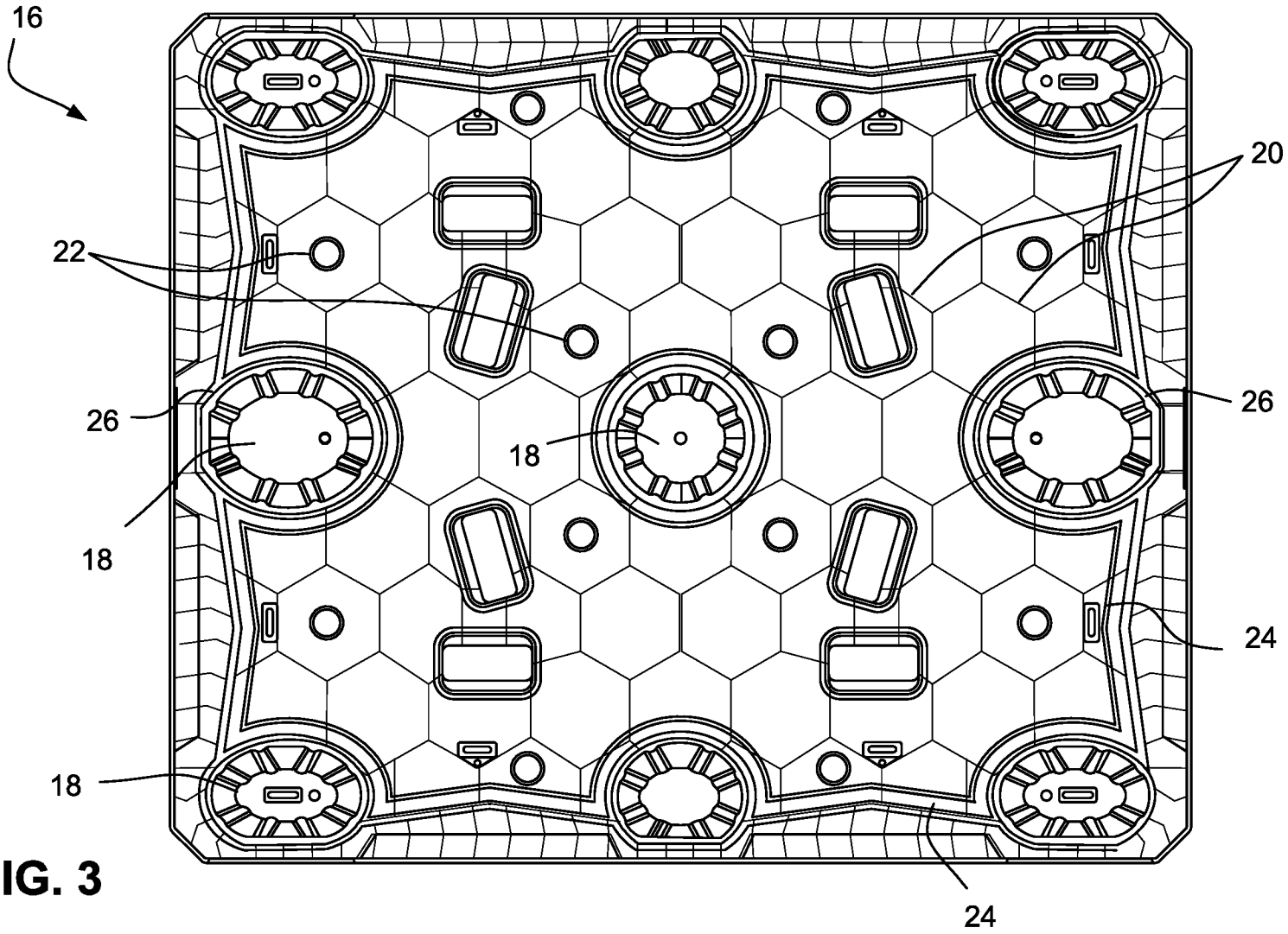
FIG. 3 is a top view of the lower panel.

FIG. 3 is a plan view of the lower panel 16 without the upper panel 12. To increase structural rigidity, the pallet 10 includes a plurality of ribs 20 between the lower panel 16 and the upper panel 12. The ribs 20 may extend up from the lower panel 16 into engagement with the upper panel 12, or the ribs 20 may extend downward from the upper panel 12 into engagement with the lower panel 16. In some embodiments, corresponding ribs extend from both the lower panel 16 and the upper panel 12, and the ribs 20 are connected by via hotplate welding or the like to permanently connect the ribs 20 between the lower panel 16 and the upper panel 12. The ribs 20 shown in FIG. 3 are formed into a honeycomb configuration, although other configurations may be used. Additionally, cylindrical ribs or posts 22 may also be provided to facilitate alignment, control weld parameters, and/or add to structural rigidity. In some embodiments, the cylindrical ribs or posts 22 are weld stops that are not welded and are used facilitate alignment.

Figure 4:
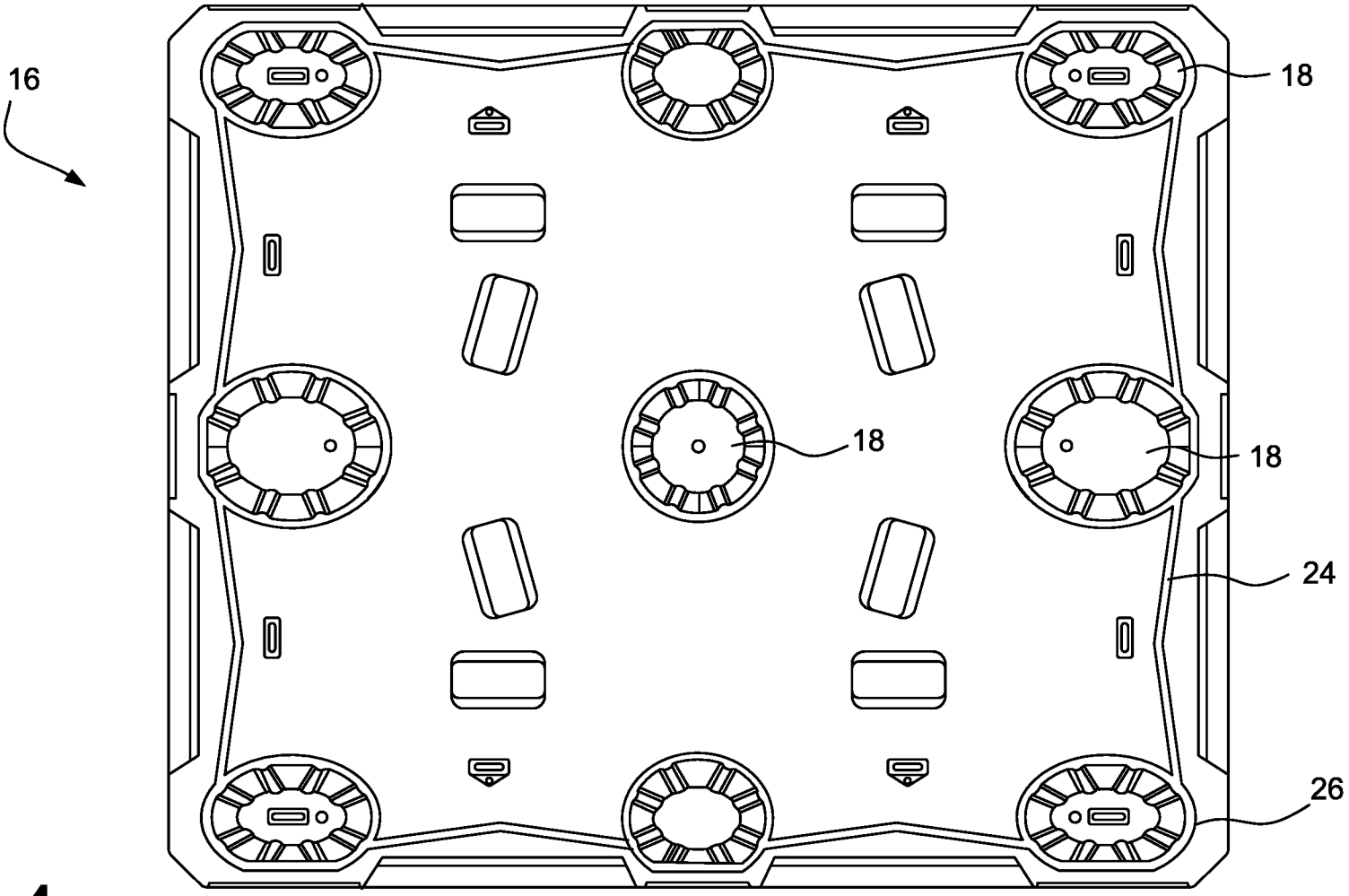
FIG. 4 is a bottom view of the lower panel.

The lower panel 16 also includes a perimeter fault or recess 24 extending adjacent a perimeter of the lower panel 16 and/or a plurality of surrounding recesses or faults 26, each extending around a respective one of the plurality of feet 18. In this manner, the feet 18 extend from a surface defined by the surrounding faults 26 rather than from the lower panel 16. As shown in FIGS. 3 and 4, the perimeter fault 24 may be continuous adjacent an entirety of the lower panel perimeter. The perimeter fault 24 generally extends foot to foot among the plurality of feet 18. The perimeter fault 24 between respective ones of the plurality of feet 18 may include two straight sections that join at a vortex as shown. The perimeter fault 24 may alternatively be curved, straight or angled. In some embodiments, the perimeter fault 24 is segmented to avoid being parallel. The perimeter fault 24 may be partially contiguous with the surrounding faults 26.

Figure 5:
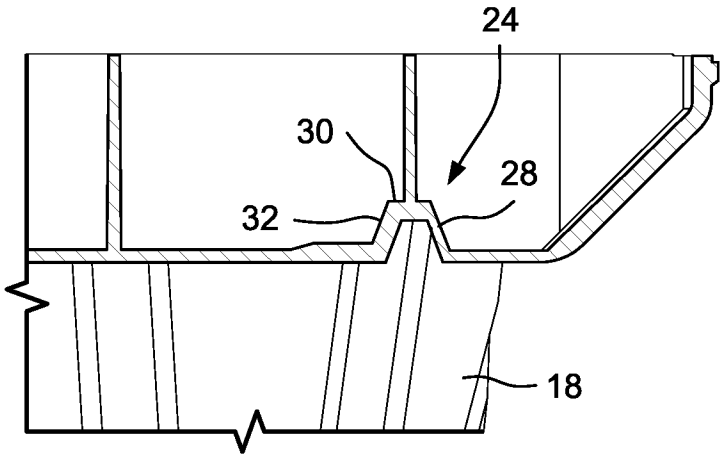
FIG. 5 is a cross-sectional view of the perimeter fault.

FIG. 5 is a cross-sectional view of the perimeter fault 24 defining a downwardly opening channel. The perimeter fault 24 may be three-sided in cross-section, including an outermost wall 28, a connecting wall 30 and an innermost wall 32. One or more of the walls 28, 30, 32 may be configured to be more flexible. For example, in some embodiments, the outermost wall 28 has a thinner wall thickness than the connecting wall 30 and the innermost wall 32.

Figure 6:
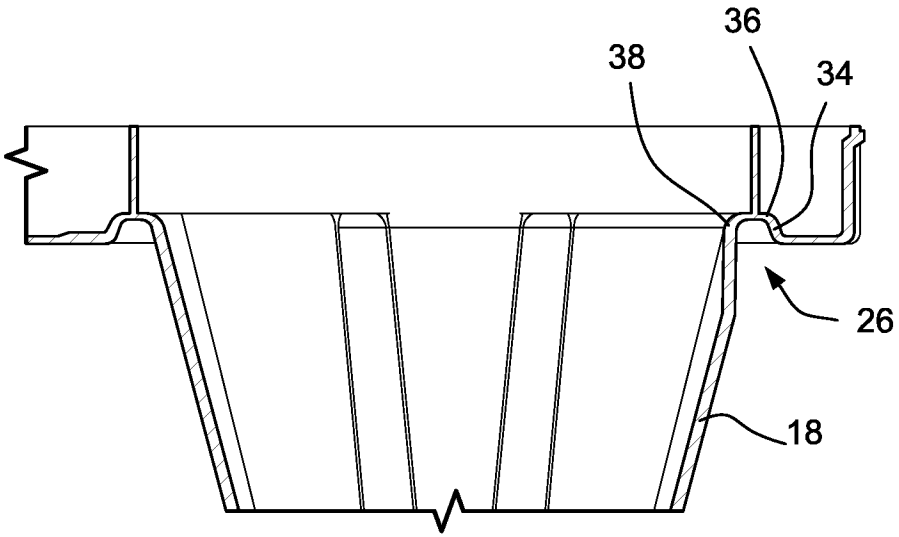
FIG. 6 is a cross-sectional view of the surrounding fault.

FIG. 6 is a cross-sectional view of an exemplary surrounding fault 26 defining a downwardly opening channel. The surrounding fault 26 is similarly three-sided in cross-section, including an outer circumferential wall 34, a joining wall 36 and an inner circumferential wall 38. One or more of the walls 34, 36, 38 may be configured to be more flexible. For example, in some embodiments, the joining wall 36 has a thinner wall thickness than the inner 38 and outer 34 circumferential walls.

The perimeter fault 24 and the surrounding faults 26 define an engineered region of reduced stiffness in line with the loads seen during impacts in the leading edge (via the perimeter fault 24) or feet (via the surrounding faults 26) of the pallet 10. The more flexible wall of the faults acts as a flexure in the case of a foot or leading-edge impact. This flexure region will bend rather than buckle or otherwise deform axially. Load transfer into members that are parallel to the impact vector will create axial compressive loads that create very little deformation for relatively high stress. High stress causes failure, and more deformation means more energy absorbed. The faults 24, 26 enable the pallet 10 to utilize bending mechanics to allow for high deformation with relatively low stress. In the case of an impact in the leading edge, the normal compression loading seen in existing pallet structures is instead converted into bending loading.

Similarly, in the case of a foot impact, the typical critical loading is the tension stress created. With the surrounding faults 26, this is once again transformed into a bending scenario. In a typical plastic pallet, the foot bends back upon impact creating a region of high tensile stress in the radius that connects the foot to the lower panel 16 and the rest of the pallet. This radius is concentrating the stress and may cause failure at the radius. As the rest of the pallet is too stiff to absorb the impact, it cannot spread to surrounding areas. With the surrounding faults 26 around the feet 18, the flexible straight section of the joining wall 36 becomes a bending region. This region will bend and distribute the load among more material rather than concentrate the tensile stress. It is beneficial to extend the surrounding faults 26 around the entire foot so that the compression stress seen on the back side of the foot is also converted into bending.

It is desirable that the deck be minimally constrained axially, i.e. allow bending. In some embodiments, this may be achieved by utilizing bent ribs 20 to induce the ribs to buckle easier than a straight rib. The bent ribs may include two straight sections that join at a vertex at an obtuse angle. See FIG. 3. This structure induces the ribs 20 to buckle at a lower stress than a straight rib in compression loading. This feature is described in commonly-owned U.S. Pat. No. 9,714,116, the contents of which are hereby incorporated by reference.

The basic mechanics as to why bending and buckling absorb more energy than direct compression or tension loading is that energy can be described as the product of force and displacement:

$$\text{Energy}=\text{Force}\times\text{Displacement}$$

An impact is exerting a discrete amount of energy into the pallet, and allowing the pallet to deform increases the displacement, thus reducing the force (loading) in the ribs.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

The invention claimed is:

1. A pallet comprising:

an upper panel including a plurality of openings;

a lower panel having an upper surface secured to the upper panel;

a plurality of feet aligned with the plurality of openings in the upper panel;

a plurality of ribs between the lower panel and the upper panel; and a perimeter fault in the lower panel extending adjacent a perimeter of the lower panel, the perimeter fault defining a downwardly opening channel in a lower surface of the lower panel.

2. A pallet according to claim 1, wherein the perimeter fault is continuous adjacent an entirety of the lower panel perimeter.

3. A pallet according to claim 1, wherein the perimeter fault extends from foot to foot among the plurality of feet.

4. A pallet according to claim 3, wherein the perimeter fault between respective ones of the plurality of feet comprises two straight sections that join at a vertex.

5. A pallet according to claim 1, further comprising a plurality of surrounding faults in the lower panel, each of the surrounding faults extending around a respective one of the plurality of feet, the plurality of feet extending from a surface defined by the surrounding faults.

6. A pallet according to claim 5, wherein the perimeter fault is partially contiguous with the surrounding faults.

7. A pallet according to claim 5, wherein the surrounding faults and the perimeter fault are three-sided in cross-section.

8. A pallet according to claim 7, wherein the three-sided cross-section of the perimeter fault includes an outermost wall, a connecting wall, and an innermost wall, and wherein the outermost wall is more flexible than the connecting wall and the innermost wall.

9. A pallet according to claim 7, wherein the three-sided cross-section of the surrounding faults includes an outer circumferential wall, a joining wall, and an inner circumferential wall, and wherein the joining wall is more flexible than the inner and outer circumferential walls.

10. A pallet according to claim 1, wherein the perimeter fault is three-sided in cross-section.

11. A pallet according to claim 10, wherein the three-sided cross-section of the perimeter fault includes an outermost wall, a connecting wall, and an innermost wall, and wherein the outermost wall is more flexible than the connecting wall and the innermost wall.

12. A pallet comprising:

an upper panel;

a lower panel having an upper surface secured to the upper panel;

a plurality of feet; and a plurality of surrounding faults defining respective downwardly opening channels in a lower surface of the lower panel, each of the surrounding faults extending around a respective one of the plurality of feet, wherein the plurality of feet extend from a surface defined by the surrounding faults.

13. A pallet according to claim 12, further comprising a perimeter fault in the lower panel extending adjacent a perimeter of the lower panel, wherein the perimeter fault is partially contiguous with the surrounding faults.

14. A pallet according to claim 13, wherein the surrounding faults and the perimeter fault are three-sided in cross-section.

15. A pallet according to claim 14, wherein the three-sided cross-section of the perimeter fault includes an outermost wall, a connecting wall, and an innermost wall, and wherein the outermost wall is more flexible than the connecting wall and the innermost wall.

16. A pallet according to claim 14, wherein the three-sided cross-section of the surrounding faults includes an outer circumferential wall, a joining wall, and an inner circumferential wall, and wherein the joining wall is more flexible than the inner and outer circumferential walls.

17. A pallet according to claim 13, wherein the perimeter fault is continuous adjacent an entirety of the lower panel perimeter.

18. A pallet according to claim 13, wherein the perimeter fault extends from foot to foot among the plurality of feet.

19. A pallet according to claim 18, wherein the perimeter fault between respective ones of the plurality of feet comprises two straight sections that join at a vertex.

20. A pallet comprising:

an upper panel including a plurality of openings;

a lower panel having an upper surface secured to the upper panel;

a plurality of feet aligned with the plurality of openings in the upper panel;

a plurality of ribs between the lower panel and the upper panel;

a perimeter fault in the lower panel extending adjacent a perimeter of the lower panel, the perimeter fault defining a downwardly opening channel in a lower surface of the lower panel; and a plurality of surrounding faults in the lower panel, each of the surrounding faults extending around a respective one of the plurality of feet, wherein the plurality of feet extend from a surface defined by the surrounding faults, wherein the perimeter fault extends between the surrounding faults among the plurality of feet.

* * * * *